US005834890A

United States Patent [19]

Girach

[11] Patent Number: 5,834,890

[45] Date of Patent: Nov. 10, 1998

[54] ELECTRODELESS FLUORESCENT LAMP

[75] Inventor: Mahomed H. Girach, Leicester, England

[73] Assignee: General Electric Company, Schenectady, N.Y.

[21] Appl. No.: 882,550

[22] Filed: Jun. 25, 1997

[30] Foreign Application Priority Data

Jun. 26, 1996 [GB] United Kingdom ..... 9613358

[51] Int. Cl.[6] ..... H01J 65/04

[52] U.S. Cl. ..... 313/493; 313/607; 313/234

[58] Field of Search ..... 313/493, 607, 313/634, 234, 573; 315/85, 248, 344

[56] References Cited

U.S. PATENT DOCUMENTS

| | | | |
|---|---|---|---|
| 4,119,889 | 10/1978 | Hollister | 315/248 |
| 4,645,967 | 2/1987 | Bouman et al. | 315/344 |
| 5,291,091 | 3/1994 | Eggink et al. | 315/344 |
| 5,412,280 | 5/1995 | Scott et al. | 313/234 |
| 5,668,433 | 9/1997 | Everest et al. | 315/85 |
| 5,708,331 | 1/1998 | Vamvakas et al. | 313/573 |

FOREIGN PATENT DOCUMENTS 0 660 375 11/1984 European Pat. Off. .

*Primary Examiner*—Nimeshkumar Patel
*Attorney, Agent, or Firm*—Fay, Sharpe, Beall, Fagan, Minnich & McKee

[57] ABSTRACT

To retain a discharge vessel 1, a groove 12 is formed in a re-entrant portion 3 of the vessel. The grooves 12 engages a corresponding notch 13 in a coil former of a coil assembly 6, housed in the re-entrant. The coil former is sufficiently resilient to be deflected by the groove as the vessel 1 is pushed onto the former. The arrangement may have means to prevent the vessel rotating about the coil assembly.

9 Claims, 3 Drawing Sheets

FIGURE 4
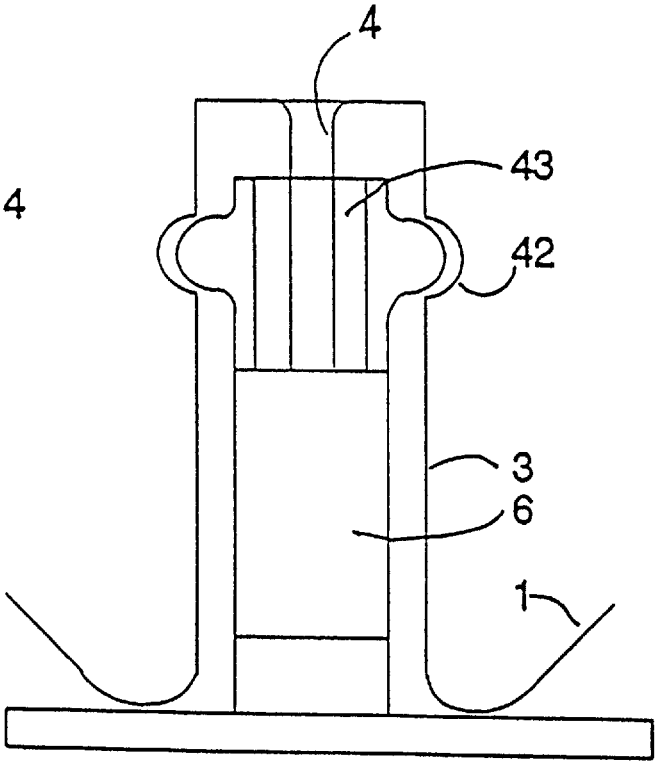
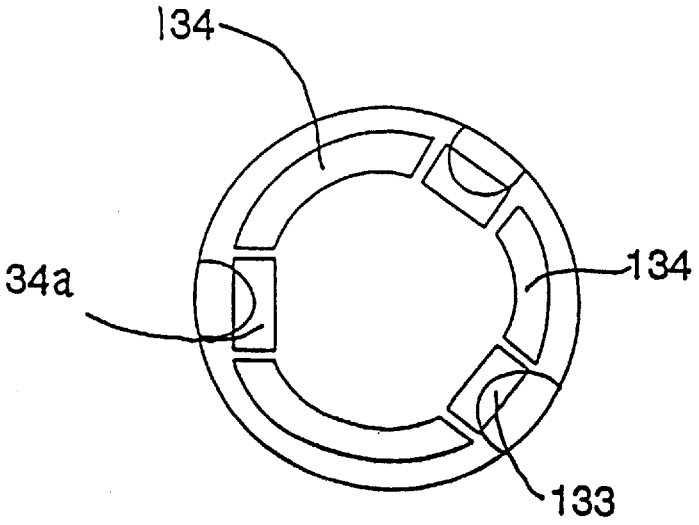
FIGURE 3B

ELECTRODELESS FLUORESCENT LAMP

BACKGROUND OF THE INVENTION

The present invention relates to an electrodeless fluorescent lamp.

An electrodeless fluorescent lamp is known for example from EP-A-0 660 375

The lamp comprises a sealed discharge vessel containing a fill which when energized sustains a discharge. The vessel is coated with, amongst other things, a layer of phosphor which converts the UV radiation of the discharge to visible light. The vessel has re-entrant portion containing a coil of a coil assembly which produces a radio frequency (RF) solenoidal field in the vessel. The coil is energized by an RF oscillator. The RF oscillator is housed in a housing which supports the coil assembly, the oscillator, and the discharge vessel. The coil assembly comprises a base member which is supported by the housing. The coil of the assembly comprises a core and a winding on the core. The core is a hollow circular cylinder of ferrite. The winding is wound directly on the core. The core and winding is fixed to the base member using a suitable adhesive. The winding is connected to connecting pins on the base member. The connecting pins provide connection to the oscillator.

In prior proposals the discharge vessel is supported by and fixed to the base member of the coil assembly or the housing. It has been proposed to fix the vessel using suitable adhesive for example.

SUMMARY OF THE INVENTION

According to the present invention, there is provided an electrodeless fluorescent lamp comprising a discharge vessel containing a fill which when energised sustains a discharge, and at least a phosphor coating on the inner surface of the vessel, the vessel having a re-entrant portion, and a coil assembly housed in the re-entrant portion for producing an RF field in the vessel to energise the fill, a notch in one of the coil assembly and re-entrant portion being engaged with a corresponding projection in the other to retain the vessel on the coil assembly.

Preferably means are provided to prevent the discharge vessel rotating about the coil assembly.

The procedure for assembling the lamp is simplified by clipping the re-entrant of the discharge vessel to the coil assembly by means of the notch and projection avoiding, for example, the use of adhesives.

For a better understanding of the present invention, reference will now be made, by way of example, to the accompanying drawings in which:

BRIEF DESCRIPTION OF THE DRAWINGS

FIG. 4 is a schematic diagram of an alternative embodiment of the lamp.

DETAILED DESCRIPTION OF THE PREFERRED EMBODIMENT

Figure 1:
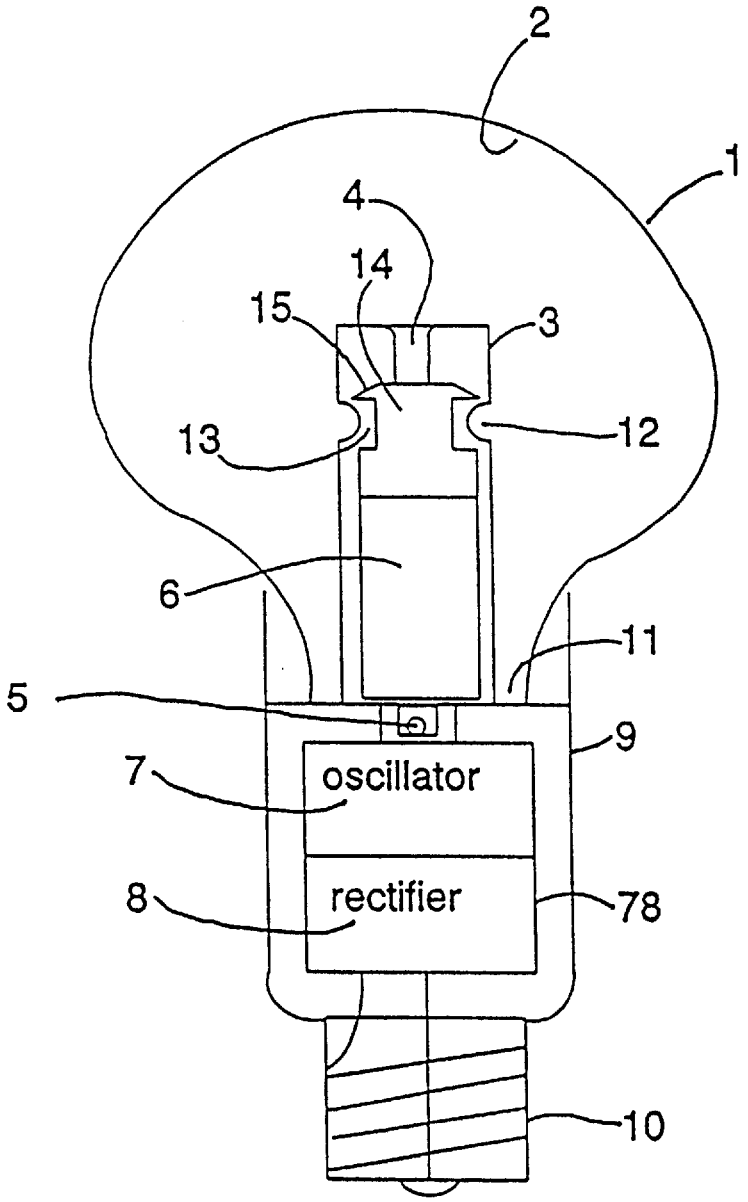
FIG. 1 is a simplified schematic diagram of an electrodeless fluorescent lamp in accordance with the invention.

Referring to FIG. 1, the fluorescent lamp comprises a sealed discharge vessel 1 containing a known fill (not shown) including mercury vapour capable of sustaining a discharge when suitably energized. The discharge produces UV light which is converted to visible light by a phosphor coating 2 on the inner surface of the vessel. The vessel may have other coatings as known in the art. The other coatings include an electrically conductive, transparent, layer (not shown).

The vessel has a re-entrant portion 3 and an exhaust tube 4 extending along the axis of the re-entrant portion. The exhaust tube contains mercury amalgam 5 in the tip thereof.

The discharge is energized by an RF field produced by a coil 6 in the re-entrant portion 3. The RF electric field is confined to the lamp by the electrically conductive transparent layer. The coil 6 is energized by a circuit 78 comprising an RF oscillator 7 and a rectifier 8.

The energising circuit 78 may be separate from the discharge vessel and coil assembly.

In accordance with an embodiment of the invention, the discharge vessel 1 is attached to the coil assembly. A circumferential groove 12 is formed in the wall of the re-entrant portion 3. The groove 12 projects radially inwardly and engages with a notch 13 formed in a coil support 14 of the coil assembly. The coil support, at least in the region of the notch, is resilient to allow a wedged end 15 of the coil support 14 to deflect to allow the groove 12 to engage the notch 13 as the discharge vessel is pushed onto the coil assembly.

Figure 2:
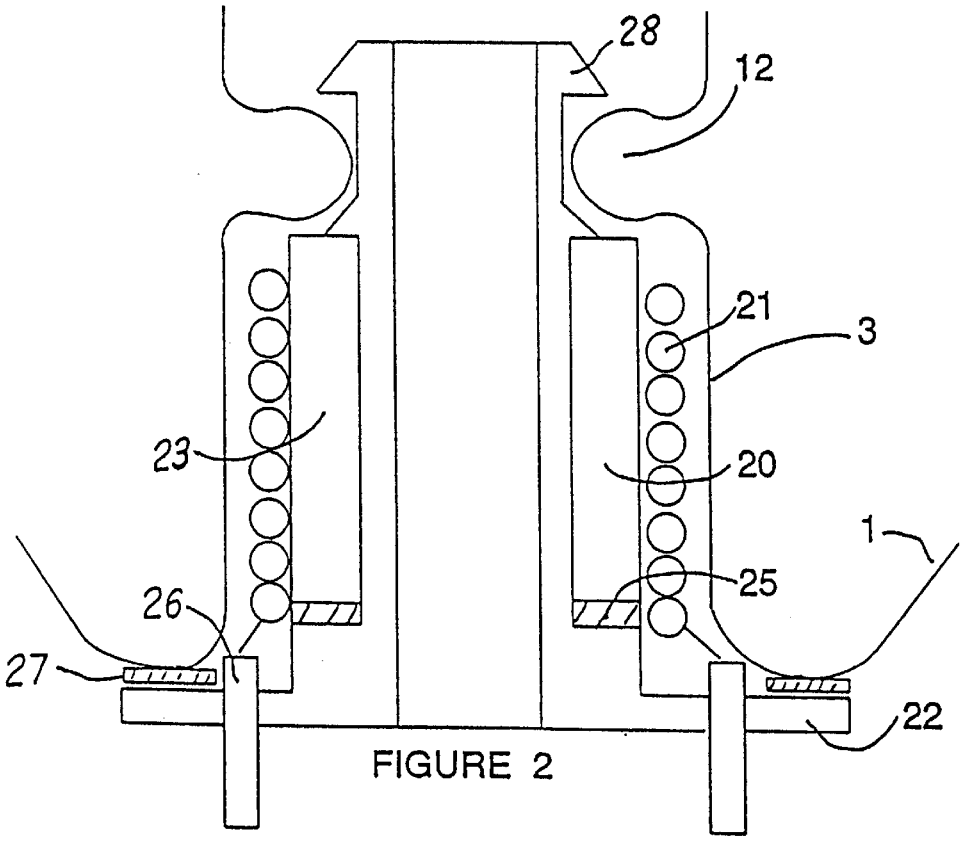
FIG. 2 is a schematic sectional view of a modification of the lamp of FIG. 1.

Referring to FIG. 2, an illustrative coil assembly comprises a hollow circular cylindrical ferrite core 20 around which a coil 21 is wound. The coil 21 may be wound directly on the core 20.

The assembly comprises a base 22 which in this example supports the discharge vessel 1.

The core 20 is a hollow circular cylinder through which the exhaust tube 4 extends. Integral with the base 22 and upstanding therefrom is at least a pair of fingers 23 which extend through the centre of the core. The fingers have, at their ends, remote from the base, lateral projections 24 which engage the core and retain it on the base.

The fingers are resilient. To assemble the core to the support, the core is pushed over the fingers until the projections engage its surface remote from the base. Thus, the fingers act as a clip.

A spring washer 25 may be provided between the core and the base 22, to prevent the core rattling on the support.

The coil 21 is soldered to pins 26 which connect the coil to the energising circuit 78.

There may be 2 to 6 fingers 23. The fingers 23 extend upwards from the base 22 beyond to the core retaining projections 24, and define between the projection 24 and further projections 28, notches 13 which engage the groove 12 in the re-entrant 3.

A springy washer 27 may be interposed between the base 22 of the coil assembly and the discharge vessel to prevent the vessel rattling on the assembly.

The discharge vessel is free to rotate around the coil assembly in the embodiments of FIGS. 1 and 2.

Figure 3A:
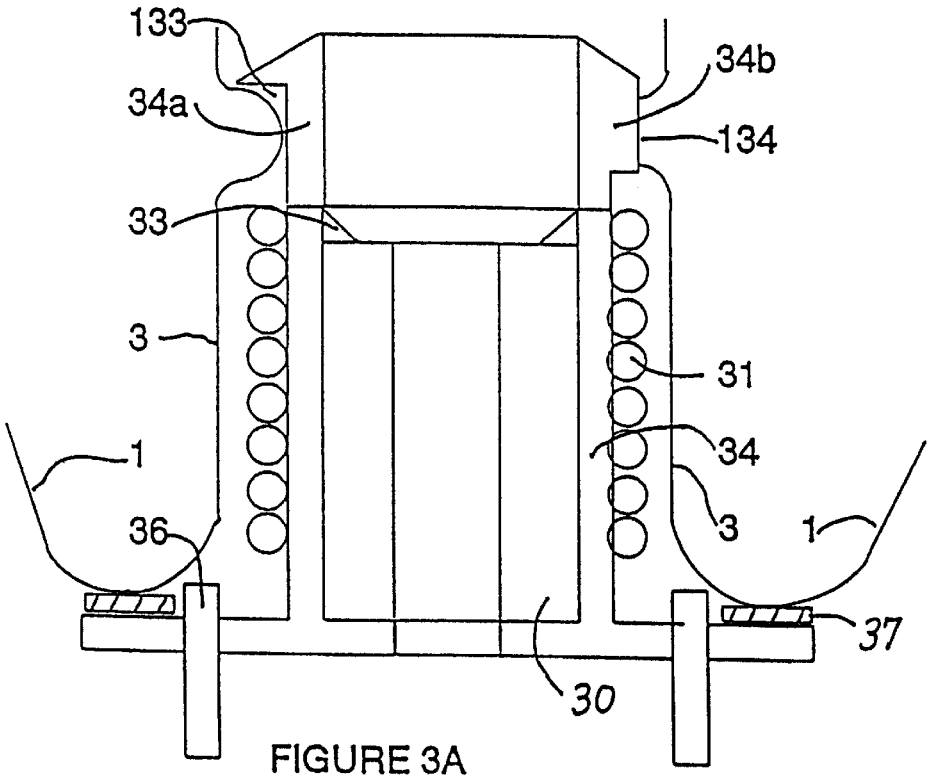
FIGS. 3(*a*) and 3(*b*) are schematic views of another modification of the lamp of FIG. 1.

Referring to FIGS. 3(*a*) and 3(*b*), another coil assembly comprises a hollow circular cylindrical ferrite core 30 and a coil 31. The exhaust tube 4 of the discharge vessel extends through the centre of the core 30.

The assembly comprises a base 32 which may support the discharge vessel in the same way as base 22 of the support of FIG. 2.

Integral with the base 32 and upstanding from it is a coil former 34. A coil 31 is wound on the former 34. The core 30 is retained within the coil former by a projections 33.

The coil 31 is soldered to pins 26 which connect the coil to the energising circuit 78. A springy washer 37 may be provided between the vessel 1 and the base 32 to prevent the vessel rattling. As shown in FIG. 3B the coil former comprises a plurality (eg. 6) of resilient fingers 34 upstanding from the base 32. Alternate ones of the fingers 34A defines notches 133; intervening ones of the fingers having projections 134 instead of notches. The re-entrant 3 is formed with 3 equally spaced projections corresponding to the notches 133 on 3 of the fingers. The projections 134 on 3 of the fingers 134 are in the valleys between the projections in the re-entrant. Thus, the vessel 1 is prevented from rotating about the coil assembly.

Referring to FIG. 4, the re-entrant 3 may be provided with a radially inwardly projecting groove 42 and the coil assembly has at least a pair of resilient fingers 32 having projections which engage the groove 42. The groove 42 may be discontinuous to prevent the vessel 1 rotating about the coil assembly.

I claim:

1. An electrodeless fluorescent lamp comprising:

a discharge vessel containing a fill which when energised sustains a discharge, and at least a phosphor coating on the inner surface of the vessel, the vessel having a re-entrant portion, and a coil assembly housed in the re-entrant portion for producing an RF field in the vessel to energise the fill, and a notch in one of the coil assembly and re-entrant portion being engaged with a corresponding projection in the other to retain the vessel on the coil assembly.

2. A lamp according to claim 1, comprising means for preventing the vessel from rotating about the coil assembly.

3. A lamp according to claim 1, wherein the notch and corresponding projection are discontinuous whereby the vessel is prevented from rotating about the coil assembly.

4. A lamp according to claim 1 wherein the re-entrant portion has one or more radially inwardly projecting projections engaged with a corresponding notch or respective corresponding notches in the coil assembly.

5. A lamp according to claim 4 wherein the re-entrant portion has a plurality of spaced projections engaged with notches provided by respective fingers, the support having at least one finger having a projection engaged between adjacent projections of the re-entrant portion.

6. A lamp according to claim 1 wherein the coil assembly comprises a core of magnetically permeable material, a winding about the core, and a support which supports the winding and core, the notch or notches being provided by the support.

7. A lamp according to claim 6, wherein the support comprises a plurality of resilient fingers providing the notch or notches.

8. A lamp according to claim 6 wherein the support is a single-piece plastic moulding.

9. A lamp according to claim 1 further comprising means for energising the coil assembly with an RF signal.

* * * * *